US010357793B2

(12) United States Patent
Harvison et al.

(10) Patent No.: US 10,357,793 B2
(45) Date of Patent: Jul. 23, 2019

(54) AUTONOMOUS PAINTING ROBOT

(71) Applicants: John M. Harvison, Land O Lakes, FL (US); Teresa Harvison, Land O Lakes, FL (US)

(72) Inventors: John M. Harvison, Land O Lakes, FL (US); Teresa Harvison, Land O Lakes, FL (US)

( * ) Notice: Subject to any disclaimer, the term of this patent is extended or adjusted under 35 U.S.C. 154(b) by 0 days.

(21) Appl. No.: 15/973,480

(22) Filed: May 7, 2018

(65) Prior Publication Data

US 2018/0318865 A1 Nov. 8, 2018

Related U.S. Application Data

(60) Provisional application No. 62/502,158, filed on May 5, 2017.

(51) Int. Cl.

| | |
|---|---|
| ***B05B 13/04*** | (2006.01) |
| ***B05C 11/00*** | (2006.01) |
| ***B05B 12/12*** | (2006.01) |
| ***B05B 13/00*** | (2006.01) |
| ***B05C 1/08*** | (2006.01) |
| ***B05C 1/16*** | (2006.01) |
| *B05C 1/02* | (2006.01) |

(52) U.S. Cl.

CPC ..... *B05B 13/0431* (2013.01); *B05B 12/122* (2013.01); *B05B 13/005* (2013.01); *B05C 1/0886* (2013.01); *B05C 1/16* (2013.01); *B05C 11/00* (2013.01); *B05C 1/027* (2013.01); *B05C 1/08* (2013.01)

(58) Field of Classification Search

None

See application file for complete search history.

(56) References Cited

U.S. PATENT DOCUMENTS

| | | | | |
|---|---|---|---|---|
| 6,941,199 | B1 * | 9/2005 | Bottomley | G05D 1/0221 318/587 |
| 2004/0141784 | A1 * | 7/2004 | Patton | B41J 3/4073 400/323 |
| 2013/0122186 | A1 * | 5/2013 | Hoppel | B05B 12/12 427/8 |

* cited by examiner

*Primary Examiner* — Nathan T Leong

(74) *Attorney, Agent, or Firm* — Christopher Mayle; John D. Houvener; Bold Patents, PLLC

(57) ABSTRACT

An autonomous machine for the application of paint to a targeted application area. The autonomous machine operates with complete autonomy to paint a room without guidance or intervention. The autonomous machine includes a propulsion system to generate movement along a surface, a sensor system that generate signals representative of conditions during the painting to a targeted application area, and a control system that is in communication with the propulsion system and applicator system. In operation the autonomous machine automatically moves to and along walls that need to be painted. The autonomous machine detects the boundaries of the walls. A sensor head on the autonomous machine scans the walls, detecting and accommodating for any obstacles such as windows and windows trim present on the walls. Pressurized paint is then moved from a reservoir in the autonomous machine to the applicator and the applicator begins applying paint to the targeted application area.

10 Claims, 5 Drawing Sheets

Mechanical-Electrical
Control System

AUTONOMOUS PAINTING ROBOT

CROSS-REFERENCE TO RELATED APPLICATIONS

This application claims priority to U.S. Provisional Application No. 62/502,158 filed on May 5, 2017. The content of the above application is hereby expressly incorporated by reference herein in its entirety.

FIELD OF DISCLOSURE

The overall field of this invention is a system and method for an autonomous painting robot. More particularly, the invention is directed to a robot capable of automatically painting a targeted application area such as a wall.

BACKGROUND

Colors or groups of colors play an enormous role in how people perceive the world. Colors have the ability to trigger different behaviors and evoke certain emotions. Warm colors such as yellow, orange, and red, elicit emotions ranging from warmth and comfort to rage and aggression. Colder colors such as green, blue, and purple, on the other hand often provoke feelings of calmness and also sadness. When considering how to paint the walls in a bedroom, kitchen, office boardroom, or bathroom, not only does right paint color choice make a huge difference in how the room feels but also how well the paint is actually applied to the walls.

Paint itself is fairly inexpensive but applying the paint can be very repetitive, exhausting, and even dangerous with some paints made up of hazardous materials. Painting and applying surface coatings are also time consuming, requiring manual application of paint brushes and rollers multiple times. The use of step ladders or other apparatuses are even needed when painting higher ceiling walls. Other options include finding and hiring a contractor to paint the walls, but this quickly becomes a costly endeavor and can lead to unpredictable results.

To combat these problems, high velocity sprayers that include a series of piston pumps, to spray paint at a higher velocity at an increased range have been used but the sprayers still require human operation. Automatic painting devices have become more common in industries such as the automobile industry, but these devices are usually stationary as the actual vehicle moves on a conveyor belt or other track and is painted as it navigates past the painting devices. These automatic painting devises are also very costly and have very complicated machinery with sophisticated robotic arms. These devices are not constructed to be utilized in a residential environment.

Currently autonomous control devices used in the home, interact with the environment randomly or require to be preprogrammed to identify their position and the device's surroundings. The control devices are typically command-based or initial outcome based which require numerous calculations but do not account for the unpredictable nature of the environment. Using a device to perform new tasks in various environments requires large amounts of software and programming. It would be valuable if the device could act on impulse and then modify its actions based on a series of regulators commands. This would allow individual devices such as robots to be more flexible and also make such devices less expensive.

A similar system can be found in humans. Humans have impulses. They follow their impulses until they find the limit of that action. An outside party such as the government, a parent, or a teacher, provides an external regulation. Their minds integrate the internal motivations with the external limiters.

Human beings do not calculate "foot speed" to arrive at a certain point in space at a certain time. Their minds do not know how to perform the calculus required to catch a football. Humans control what they feel. Thus, there still exists a need for a painting robot with control system that "feels" like it is in the right place or doing the right operation and makes simple adjustments in order to "perceive" based on the environment and objective the robot is working its correctly. A need also exists for a painting robot that uses a series of sensors, logic control, and task performers to completely perform the task of painting autonomously without assistance from a user whereby the robot actually maneuvers around the room, identifies and seek out the area that needs to be painted, ascertain any obstacles or challenges in the device's path and instead of avoiding them, integrating and connecting with them, and then applying the paint evenly and uniformly to the targeted application area.

SUMMARY

The present invention will be described by way of exemplary embodiments, but not limitations, illustrated in the accompanying drawings in which like references denote similar elements, and in which:

Embodiments in the present description are directed to an automated painting robot, comprising: a propulsion system configured to generate movement, an applicator system, including an applicator configured to apply paint to a targeted application area; and, one or more sensors connected to one or more controllers, the sensors configured to generate input data representative of conditions during operation and to provide input data to the controllers, the controllers configured for storing one or more expected reference values, the controllers configured to compare the input data with the expected reference values, the controllers configured to output a output signal, the output signal derived from the comparison of the input data with the expected reference values, the output signal configured to perform one or more actions in at least one of the propulsion system and the applicator system to satisfy a condition of the input data returning to expected reference values.

It is an object of the present description to provide a method for an autonomous painting robot painting a targeted application area, the method comprising the steps of: positioning an autonomous painting robot on a surface, the autonomous painting robot having a propulsion system generating movement; an applicator system applying paint to a targeted application area; one or more sensors connecting to one or more controllers; the sensors generating input data representative of conditions during operation and providing the input data to the controllers, the controllers storing one or more expected reference values, the controllers comparing the input data with the expected reference values; the controllers outputting a output signal, the output signal derived from the comparison of the input data with the expected reference, the output signal performing one or more actions in at least one of the propulsion system and the applicator system to satisfy a condition of the input data returning to the expected reference values.

It is an object of the present description to provide an automated robot, comprising: an action system configured to generate one or more actions, one or more controllers configured for storing one or more expected reference values, the controllers configured to be in a constant state of performing one or more actions in the action system in response to the expected reference values until the occurrence of one or more limitations, one or more sensors connected to the controllers, the sensors configured to generate input data representative of the limitations during operation and to provide input data to the controllers, the controllers configured to compare the input data with the expected reference values, the controllers configured to output a output signal, the output signal derived from the comparison of the input data with the expected reference values, the output signal configured to perform one or more actions in the action system to satisfy the limitations of the input data returning to the expected reference values, the controllers connected hierarchically to provide data passage in between one or more lower level controllers to one or more higher level controllers, the lower level controllers responsive to the supervisory control of the higher level controllers, wherein the higher level controllers are configured to disallow the lower level controllers performing one or more actions in the action system.

BRIEF DESCRIPTION OF DRAWINGS

The present invention will be described by way of exemplary embodiments, but not limitations, illustrated in the accompanying drawings in which like references denote similar elements, and in which.

DETAILED DESCRIPTION

Figure 1:
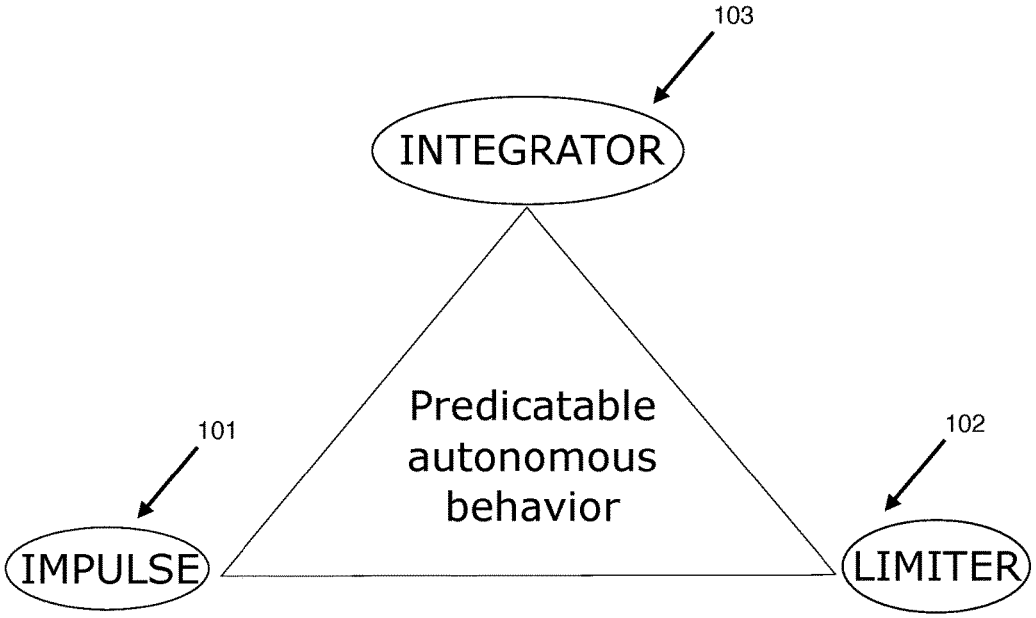
FIG. 1 depicts a schematic diagram of an exemplary three part controller used for predictable autonomous behavior in an exemplary autonomous painting robot.

In the Summary above and in this Detailed Description, and the claims below, and in the accompanying drawings, reference is made to particular features of the invention. It is to be understood that the disclosure of the invention in this specification includes all possible combinations of such particular features. For example, where a particular feature is disclosed in the context of a particular aspect or embodiment of the invention, or a particular claim, that feature can also be used, to the extent possible, in combination with and/or in the context of other particular aspects and embodiments of the invention, and in the invention generally.

Where reference is made herein to a method comprising two or more defined steps, the defined steps can be carried out in any order or simultaneously (except where the context excludes that possibility), and the method can include one or more other steps which are carried out before any of the defined steps, between two of the defined steps, or after all the defined steps (except where the context excludes that possibility).

"Exemplary" is used herein to mean "serving as an example, instance, or illustration." Any aspect described in this document as "exemplary" is not necessarily to be construed as preferred or advantageous over other aspects.

Throughout the drawings, like reference characters are used to designate like elements. As used herein, the term "coupled" or "coupling" may indicate a connection. The connection may be a direct or an indirect connection between one or more items. Further, the term "set" as used herein may denote one or more of any item, so a "set of items," may indicate the presence of only one item, or may indicate more items. Thus, the term "set" may be equivalent to "one or more" as used herein.

The present disclosure recognizes the unsolved need for an autonomous painting robot that offers an efficient way to maneuver around the autonomous painting robot's environment, identify and scan a targeted application area, and apply paint to the targeted application area. The autonomous painting robot, in one or more exemplary embodiments described herein, when positioned, self-directs itself around the environment to seek out and perform work on the targeted application area. The embodiments for an autonomous painting robot described herein accomplishes this objective by first creating input data from both action parameters and sensor data, then feeding the input data into logic control, followed by generating output data from the logic control, and then finally performing work such as motion, and self-positioning, and predictable autonomous behavior in accordance with the output data. Further details regarding embodiments in the present description will be provided below with respect to the accompanying Figures.

FIG. 1 is an illustration of the basic control system constructed accordance with the principals of the current invention, with an impulse such as impulse 101 including a mechanical or electrical impulse, input, or action, a limiter such as limiter 102 including a mechanical or electrical limiter, restriction or setting, and an integrator such as integrator 103 including a mechanical or electrical integration system.

The preferred embodiment of this invention is electrically powered. This electronically powered embodiment reflects the three part controller shown in FIG. 1. The motors are represented by impulse 101. The sensors and walls are represented by limiter 102. The microprocessor is represented by integrator 103.

In the electrical embodiment, the control system such as control system 120 receives data input. A comparison controller evaluates the data input against a setting or expectation of a certain range of value stored on a memory controller. The control system activates a process or action in the other systems while at the same time monitoring data serves as a measurement of a particular state or set of states that changes as a result of the input. An integration function controls the transition from state to state. With this architecture of the control system, it not necessary to establish particular values of the output but to modify the output until the objective is achieved. The control system is in constant motivation to complete one or more actions. If the control system perceives itself in an undesirable state, then the goals may be changed until the desired state is once again established.

Figure 2:
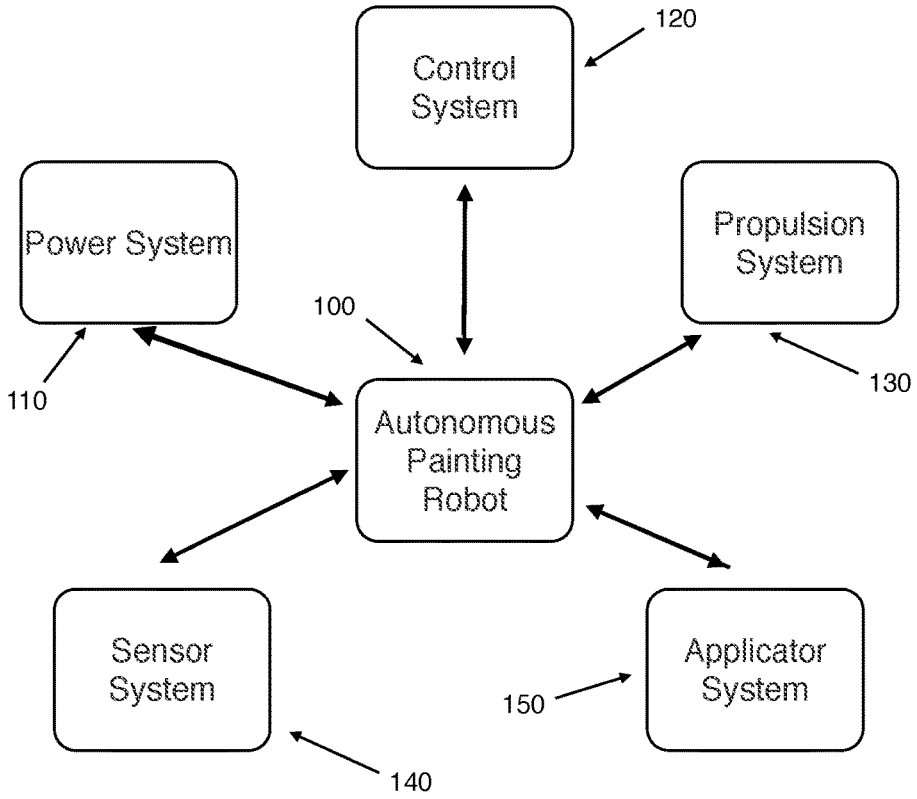
FIG. 2 depicts a schematic diagram of various systems of the exemplary autonomous painting robot.

FIG. 2 depicts a schematic diagram of one embodiment of the autonomous painting robot 100. Autonomous painting robot 100 may have a plurality of systems including a power system such as power system 110, control system 120, propulsion system such as propulsion system 130, sensor system such as sensor system 140, and applicator system such as applicator system 150, which may be integrated in combination with the housing structure of autonomous painting robot 100. The various systems may be individually configured and correlated with respect to each other so as to attain the desired objective of painting a targeted application area (e.g. walls or any other location or surface).

Power system 110 of autonomous painting robot 100 provides the energy to power propulsion system 130, sensor system 140, and applicator system 150, and the circuits and components of control system 120 during the process of seeking out, scanning, and painting a targeted application area. Autonomous painting robot 100 may be powered by methods known by those of ordinary skill in the art. In some embodiments, autonomous painting robot 100 may plug into an electrical outlet using an electrical cord to supply power to propulsion system 130, sensor system 140, control system 120, and an applicator system 150. Further power system 110 may include a rechargeable battery pack mounted inside of the housing whereby the rechargeable battery is of a charge, design, and capacity, to provide sufficient power to propulsion system 130, sensor system 140, control system 120, and applicator system 150 while running autonomous painting robot 100 for a set period of time needed to paint a targeted application area.

Control system 120 may be used as a single controller or with a multiplicity of controllers arranged in a myriad of configurations. Each set of these controllers may be connected hierarchically to provide data passage from the lower level controllers to the higher level controllers, from the higher level controllers to the lower level controllers or any combination thereof to build, layer by layer. The lower level controllers may be responsive to the supervisory control of the higher level controllers whereby if the control system is motivated by the lower level controllers to cause an action in one or more action systems the action may be overridden by the higher level controllers. Thus control system 120 causes an action in one or more action systems motivated by the higher level controllers. Sometimes the references may not be configured correctly for the environment. Control system 120 may have an overriding system that makes adjustments to reference values ranges in order to resolve the conflict and allow autonomous painting robot 100 to function properly.

Control system 120 may include control circuitry and one or more microprocessors or controllers capable of receiving input from sensor system 140, analyzing the input from sensor system 140, and generating an output signal to propulsion system 130, power system 110, and applicator system 150. The microprocessors (not shown) may have on-board memory to control the power that is applied to propulsion system 130, power system 110, and applicator system 150 in response to input signals from the user on the control panel and from sensor system 140. Control system 120 may be preprogrammed with any references values, by any combination hardwiring, software, firmware to implement various operational modes including detecting and identifying a targeted application area and applying paint to the targeted application area.

Control system 120 may include circuitry to provide an actuable interface for the user to interact with, including switches and indicators and accompanying circuitry for an electronic control panel or mechanical control panel. Such an actuable interface may present options to the user to select from such as, without limitation, dimensions for a wall or other targeted area needing paint, the distance from the walls, or controlling the number of paint layers to be applied to the wall.

The microprocessors in control system 120 may also monitor the current state of circuitry within control system 120 to determine the specific mode of operation chosen by the user. For instance, when the ON input is selected, the microprocessors may begin autonomously starting to identify and apply paint to the targeted application area by controlling and sending instructions to sensor system 140, propulsion system 130, and applicator system 150. In other embodiments, there may sub-modes such as an "Analyze" mode in which the targeted application area is identified and scanned, whereby the microprocessors included in the control system 120 control and send relevant instructions to sensor system 140 and propulsion system 130. Another sub-mode may include "Paint" mode in which the paint is applied to the targeted application area, whereby the microprocessors control and send instructions to propulsion system 130 and applicator system 150.

Further, such microprocessors that may be part of control system 120 may receive signals from propulsion system 130, applicator system 150, power system 110, and sensor system 140, such as whether any of the components in the various systems need to be replaced, whether the paint reservoir needs to be filled, as well as when the targeted area of application has been painted.

Control system 120 may have a communications module (not shown) to connect with other robots or computing devices such a computer, mobile phone, laptop, or tablet whereby signal transmitted from the computing devices may be received by control system 120. For example, autonomous painting robot 100 may transmit to an associated computing device the status and video of autonomous painting robot's 100 operation while the computing device may upload artwork of the user's own creation using computer graphics software or uploaded to the computing device by conventional means such as scanners.

Propulsion system 130 may have separate subsystems that include propelling autonomous painting robot 100 to maneuver around the environment, driving the linear motion of the sensor head, and operating the applicator for application of paint on the targeted application area, which may work in conjunction with each other or independently from one another.

To maneuver around the environment, propulsion system 130 of autonomous painting robot 100 may include a left wheel assembly and right wheel assembly having a front left wheel and back left wheel as well and front right wheel and back right wheel, the left wheel assembly and right wheel assembly each having their own independently operated motors. In one embodiment, the distance between the front and rear wheels is much smaller than the distance between the left and right wheels to provide enhanced omnidirectional turning capabilities. However, the distances are non-limiting and the wheels may be separated at any distance that is suitable for maneuvering around an environment in specifically tailored situations.

In addition to the above, axels may be fixed to the centers of the left wheel and right wheel in an exemplary embodiment of autonomous painting robot 100, whereby the axels are configured to rotate with the wheels and the axles are mechanically coupled to the motors and are used to drive the wheels. The left wheel assembly and right wheel assembly may be mounted within wells or other sections on opposite ends of the housing to deliver enhanced turning capabilities when navigating through the environment. The wheels are preferably of a diameter, shape, and material, to enhance their traction force when traversing an environment steering and to provide ease in steering and turning. However, this is non-limiting and autonomous painting robot 100 may have any wheel arrangement and configuration as well have 360 degrees wheels or a wheel in the center of autonomous painting robot 100 to provide minor corrections.

The motors for the left wheel assembly and right assembly may drive the left wheel assembly and right assembly at equal speed in the same direction to move autonomous painting robot 100 forward or reverse in a straight line as well as at different speeds to turn autonomous painting robot 100. For instance, the left motor may drive the left wheel assembly to turn the front left wheel and back left wheel in a clockwise direction while the right motor is inactive. This exemplary method of operation may be used to turn autonomous painting robot 100 slowly to the right. A quicker turn to the right may be produced by the left motor driving the left wheel assembly to turn the front left wheel and back left wheel in a clockwise direction with the right motor driving the right assembly to turn the front right wheel and back right wheel in a counterclockwise direction.

Propulsion system 130 may have a rotary or step motor to drive the linear motion of the sensor head and applicator connected to the mast used to convert rotational energy produced by the motors into linear movement. This may be accomplished by the lead screw having an axially rotating threaded rod, upon which is engaged a slip nut attached to the sensor head. As the rod rotates, the sensor head moves linearly in a vertical direction. The mast is further described later in the description.

Sensor system 140 may include a plurality of detectors mounted to the housing of autonomous painting robot 100 in the form of standard infrared ("IR") detectors having photodiode and related amplification and detection circuitry. In other embodiments, radio frequencies, magnetic fields, and ultrasonic sensors and transducers may be employed. Detectors may be arranged in any number of configurations and arrangements. For example, in one embodiment autonomous painting robot may include an omnidirectional detector mounted to the top and bottom of autonomous painting robot 100 to detect signals from a 360 degrees field of view while in other embodiments various detectors may be mounted on the side of autonomous painting robot which may be used to form a collective field of view of detection.

Autonomous painting robot 100 may further include "detectors" in the form of cliff detectors, which may be able to reflect infrared ("IR") light off the floor near the edges of autonomous painting robot 100 to determine if autonomous painting robot 100 is approaching a drop off point or other barrier. During operation when autonomous painting robot 100 approaches a drop off point, such as the top of a staircase without limitation, the cliff detectors may send a signal through control system 120 to the microprocessors. The microprocessors then compare the received input data using a comparison function and evaluate the input data against a setting or expectation of a certain range stored within the memory of control system 120. For instance, if the calculated distance is greater than the reference distance, the microprocessor sends a signal through control system 120 to propulsion system 130 commanding the motors on the left side and motors on the right side to drive the wheels away from the drop to ensure autonomous painting robot 100 does not fall of the ledge or cliff Such exemplary detectors may be in the form of impact sensors that are triggered when autonomous painting robot 100 has a collision with another object. For example, having detectors may be particular useful during operation when autonomous painting robot 100 is about to collide with an outside object, such as a household pet or other item. The impact detectors send a signal through control system 120 to the microprocessors containing an input value. The microprocessors then compare the received input value using a comparison function and evaluate the input data against a setting or expectation of a certain reference value stored within the memory of control system 120. If the calculated value is outside the expected reference value the microprocessors then send a signal through control system 120 to propulsion system 130 commanding the motors on the left side and motors on the right side to drive the wheels away from the position of the outside object.

Detectors may be in the form of wall detectors on the left and right sides of autonomous painting robot 100, which may reflect IR light from the sides of autonomous painting robot 100 to determine if autonomous painting robot 100 is approaching a wall or other object. The wall detectors send a signal through control system 120 to the microprocessors containing an input value. The microprocessors then compare the received input value using a comparison function and evaluate the input data against a setting or expectation of a certain reference value for a "stand off" position stored within the memory of control system 120. In one embodiment, based on if the input data is above or below the expected reference value, autonomous painting robot 100 may maintain a set distance from the wall by commanding the motors on the left side and motors on the right side either deactivate or to drive the wheels away or closer to the wall.

Once autonomous painting robot 100 is in a "stand off" position, signals may be continually sent from the sensors to the microprocessors which then continuously compare this signal using a comparison function and evaluate the input data against a setting or expectation of a certain range to keep autonomous painting robot 100 parallel to the wall. Then as autonomous painting robot 100 moves along the wall and the wall sensors identify an adjacent wall and send signal through control system 120 to the microprocessors containing an input value. The hierarchy of control system 120 enables autonomous painting robot 100 to turn away from the original wall and towards the adjacent wall.

For instance, when sensor input data is within an expectation of a certain range, lower level system controller control system 120 is configured to maintain autonomous painting robot's 100 wall hugging behavior until it finishes the last stroke of paint. After the last stoke of paint is completed, the autonomous painting robot 120 may attempts to resume its course along the original wall. However, a higher level system controller of control system 120, is configured to turn autonomous painting robot 100 when sensor input data detects an adjacent wall thus overriding the original function. The lower level system controllers are responsive to the supervisory control of the higher level controller, so the higher level controllers override the lower level controllers signals to the other systems. The microprocessors then send a signal through control system 120 to propulsion system 130 to reduce the drive in the left and right wheels as autonomous painting robot 100 comes closer to the adjacent wall and to increase the rate of rotation by increasing drive in one wheel and reducing in the other wheel, thus turning away from the first wall.

Sensor system 140 may include one or more sensor heads, whereby the one or more sensor heads may be used to collect boundary data such as edges of wall trim such as wall trim and window trim such as window trim. The sensor head may include photoelectric sensors, or other sensors in place that detect change in light intensity to detect specific images, patterns, colors, or styles on the wall. During operation when autonomous painting robot 100 is moving along a wall, the sensor head sends a signal through control system 120 to the microprocessors including an input value identifying any obstacles or different sections as window trim or wall trim, boundaries such as the ceiling, as well as any patterns, colors, or designs. The microprocessors that may be included in control system 120 may then compare the received input value using a comparison function and evaluate the input data against a setting or expectation of a certain reference value stored within the memory of control system 120. Control system 120 then may send a signal to the other systems based on signal from the sensor head. During the application of paint to a targeted application area by autonomous painting robot 100, the sensors may work in union with each together or independently to accomplish this objective.

The described sensors are merely for descriptive purposes and are non-limiting to alternative embodiments. Sensor system 140 may utilize any technologies that may be exploited to locate or create and identify boundary limits to locate physical, chemical, electrical, magnetic, acoustic or temperature boundaries or conditions set into place by another agent, machine, assembly or controller.

Figure 3:
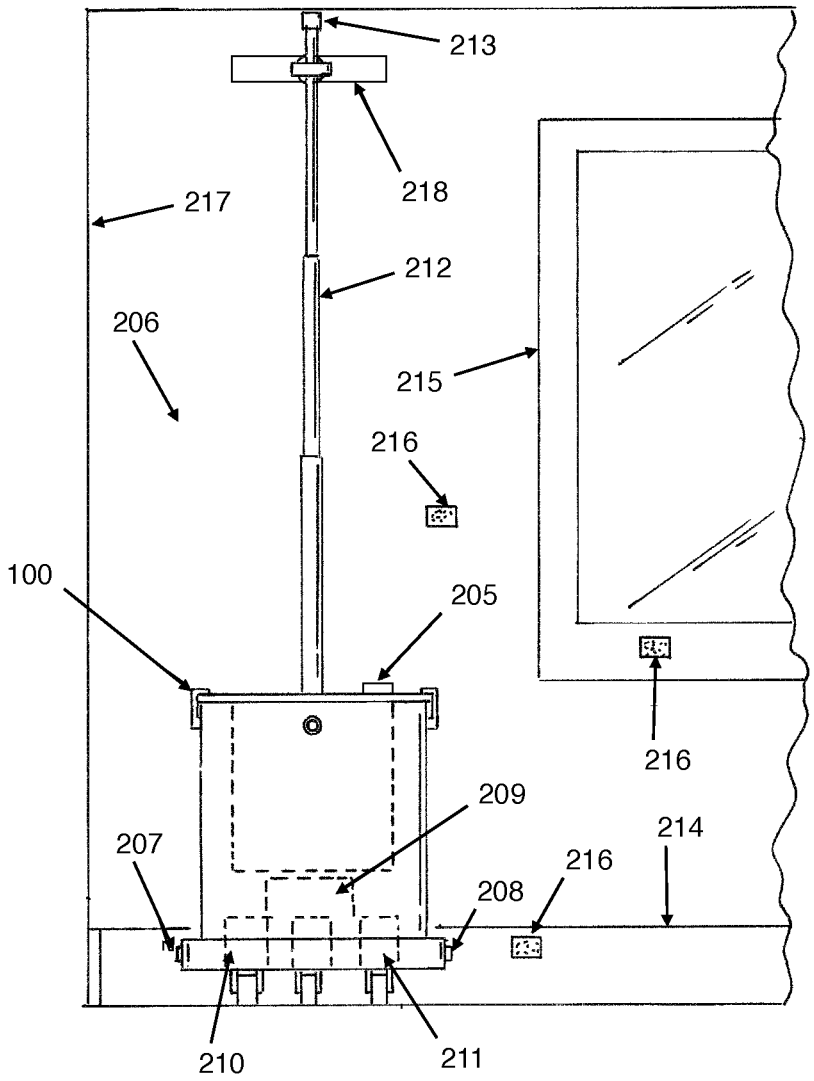
FIG. 3 depicts a backside elevation view of the exemplary autonomous painting robot.

FIG. 3 illustrates one embodiment of autonomous painting robot 100 as well as an exemplary method of operation. Autonomous painting robot 100 may be activated by selecting options on the control panel such as control panel 205. When autonomous painting robot 100 is placed on the floor, the microprocessors, such as microprocessor 209, compares the signals from a series of sensors such as sensors 207 and 208 with a set distance preprogrammed in the memory or entered by the user for autonomous painting robot 100 to stand off or move away from a wall, such as wall 206. Microprocessor 209 then may then send a signal to propulsion system 130, commanding the left motor and right motor to drive the left wheel assembly and right assembly such as left wheel assembly 210 and right assembly 211 to move toward wall 206. As autonomous painting robot 100 approaches wall 206, sensors 207 and 208 send signals to the microprocessor 209, which then compares the readings of the distance to wall 206 with the expected set distance to wall 206.

As autonomous painting robot 100 moves towards wall 206, the microprocessor 209 may perform an integration of the distances to send a signal to propulsion system 130 and left wheel assembly 210 and right assembly 211 to smoothly increase and decrease the speed of autonomous painting robot 100 as it moves closer or farther from wall 206. As the distance on the left side of autonomous painting robot 100 comes to rest at the set distance from wall 206, the right side of autonomous painting robot 100 is similarly brought to its set distance from wall 206. This combined action sets autonomous painting robot 100 parallel to wall 206 at a fixed "stand-off" or offset distance.

Autonomous painting robot 100 then may pivot and start to move in a linear direction in the left or right direction along wall 206 while maintaining a parallel position to wall 206. As autonomous painting robot 100 moves in a linear direction along wall 206, a sensor head such as sensor head 213 connected to a mast, such as mast 212, may move in a linear direction in the upward and downward directions to allow sensor head 213 to scan wall 206. Mast 212, in one embodiment, may be an elongated member that extends upwardly away from a top surface of a housing for autonomous painting robot 100.

When sensor head 213 is scanning wall 206, the various sensors on sensor head 213 may collect boundary data such as edges of wall trim, such as wall trim 214, and window trim, such as window trim 215. Wall 206, wall trim 214, and window trim 215 may have operational indicators (e.g. operational indicators 216) depicting proper color, patterns or style to be applied to the wall that may be identified by sensor head 213 and used to paint a specific area, such as wall 206, wall trim 214, and window trim 215. Operational indicators 216 allow modifications to the standard operation of autonomous painting robot 100. The Operational indicators may be in the form of an image or a scannable code such as a QR code. This modified behavior allows autonomous painting robot 100 to produce various images on the walls.

Once wall 206 is scanned, autonomous painting robot 100 may then seek out the boundaries and scan one or more adjacent walls such adjacent wall 217 in a similar manner if multiple walls needed to be painted. Applicator system 150 may then apply paint to wall 206 as well as adjacent wall 217 if needed. Autonomous painting robot 100 moves to one of the boundaries of wall 206 and an applicator, such as applicator 218 connected to mast 212, may begin painting as mast 212 moves upwards and downwards in a vertical direction creating a strip of paint. Applicator 218 may have a body with openings for dispensing paint. Applicator system 150 may incorporate a spray nozzle, a roller, brusher or other apparatus capable of applying paint to a wall. In some embodiments, applicator 218 may include a printer capable of applying specific decorations or patterns to a wall.

Autonomous painting robot 100 may then move laterally along wall 206 at a certain distance and be configured to readjust its orientation. Applicator 218 may begin painting the next strip or section of the targeted area until the targeted area has been painted. Autonomous painting robot 100 may have overlap between every two successive paint strips to provide continuity for the paint. The overlap may be adjusted by a user as desired or automatically by control system 120 depending on the specific objective. Sensor head 213 may then scan wall 206 after paint has been applied sending the information as a signal to control system 120, which may determine if a second paint coating is needed well as ensure the pattern or design is properly applied. Further signals may be sent to make any necessary alterations.

Figure 4:
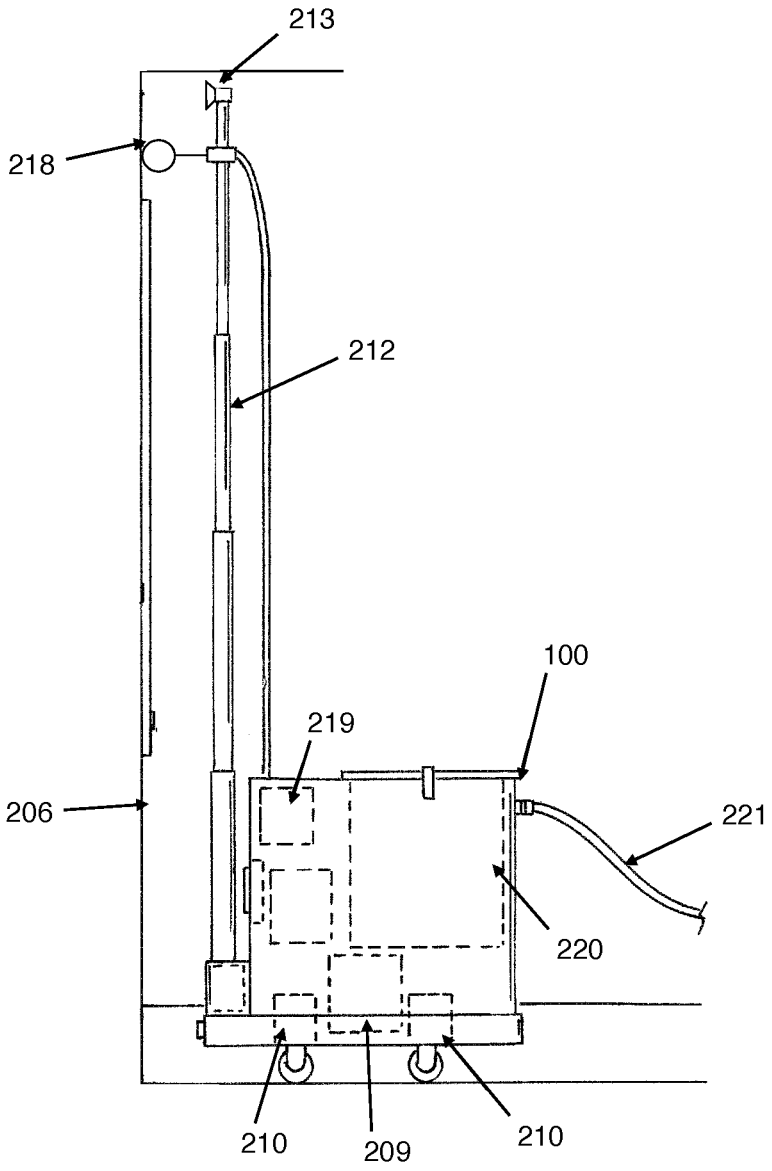
FIG. 4 depicts a left side elevation view of the exemplary autonomous painting robot.

FIG. 4 illustrates an exemplary applicator system, shown as applicator system 150 of autonomous painting robot 100. Applicator system 150 may include a removable and refillable reservoir, such as reservoir 220, for containing paint, primer, or other types of coating material. Reservoir 220 may be located internally within a housing of autonomous painting robot 100 in some embodiments, although one of ordinary skill may appreciate that reservoir 220 may also be located anywhere on autonomous painting robot 100 in other embodiments. As shown in FIG. 4, the dotted lines are meant to indicate a symbolic location of a particular component, such as reservoir 220. Applicator system 150 may include a pump, such as pump 219. that may draw the paint from reservoir 220 and supply such paint to applicator 218 connected to mast 212 by a supply tube such as supply tube 222. In some embodiments, reservoir 220 may be positioned separate from autonomous painting robot 100, whereby an attached supply tube such as supply tube 221 may carry paint to reservoir 220 of autonomous painting robot 100.

Supply tube 220 may be of sufficient length to reach the upper boundaries of wall 206 where wall 206 meets the ceiling. In one embodiment, supply tube 220 may have a fully extended length of ten to fifteen feet, although other lengths are possible as desired. Applicator system 150 may have a reel or other apparatus to store, extend and retract the supply tube as autonomous painting robot 100 applies paint to the wall. It should be understood that autonomous painting robot 100 is not limited to painting a wall and may be used in numerous other locations and applications to paint any part of a structure or environment capable of being painted.

Figure 5:
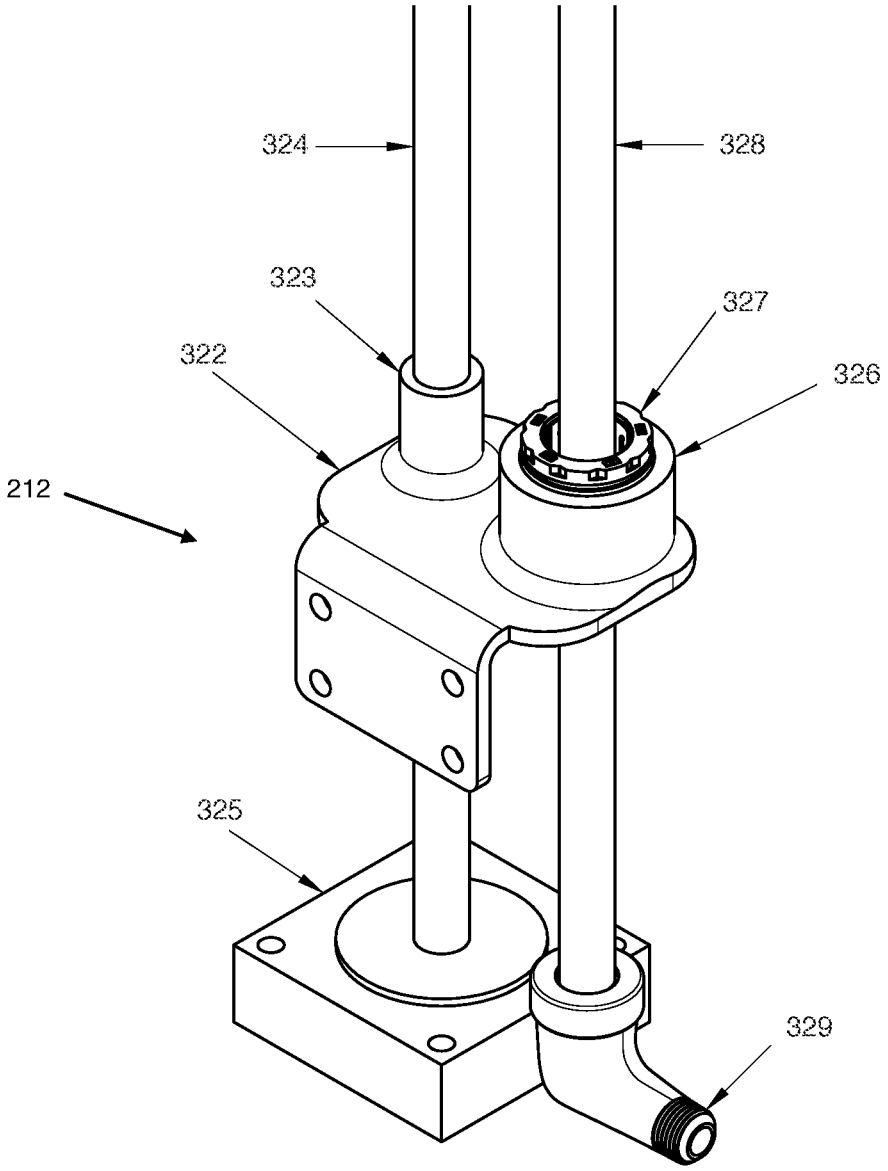
FIG. 5 depicts a perspective view of the linear motion actuator of the exemplary autonomous painting robot.

One embodiment of mast 212 is further illustrated in FIG. 5. The mast shown in FIG. 5 may include a linear motion actuator in one embodiment. Such a linear motion actuator may have a travel plate 322 with a threaded region 323 fitted to a power-screw 324. Power-screw 324 may be turned by a motor located in the housing of autonomous painting robot 100 to move travel plate 322 in linear motion upwards and downwards. The torsional force of the turning power-screw 324 is resisted by providing a sliding stabilizing bar connection, such as sliding bar connection 326 with a linear bearing such as linear bearing 327 connected to an appropriate fitting, such as fitting 329. Sliding stabilizing bar 326 may also include a conduit such as conduit 328 where liquids, wiring, powders, or other materials may pass through. In some embodiments, mast 212 may include telescoping arms that project upward from the housing of autonomous painting robot 100 sized to extend the travel plate 320 and sensor head 218 to the ceiling.

The embodiments described herein for an autonomous painting robot are meant to be exemplary and non-limiting as to how various integrated systems may interact with each other. Various other components and systems may also be included in other embodiments that are within the scope of the present description. For instance, in alternate embodiments, the autonomous painting robot may be powered by steam (not shown). The autonomous painting robot may be activated by the burning of coals into a receptacle in the autonomous painting robot or connected to the autonomous painting robot from an outside source, causing the boiling of water within the tubing of the autonomous painting robot. The tubing may be configured for the water to be cooled and returned to the boiler after passing through the various assemblies of the autonomous painting robot. The autonomous painting robot may be configured for the steam to flow through tubing to power a steam engine attached to a power-screw that drives the upper part of the autonomous painting robot toward the ceiling. A lever may be positioned above the autonomous painting robot in such a way as to come into contact with the ceiling before any other part of the autonomous painting robot. When this lever comes into contact with the ceiling, the pressure exerted by the ceiling causes the lever to move mechanical linkages that turn a valve connected to the steam engine attached to the power-screw powering the linear motion of the upper part of the autonomous painting robot.

The valve acts to reduce the flow of the steam to the steam engine turning the power-screw and reducing the power-screw's speed of rotation. Introducing springs into the configuration allows for stresses within the linkages to be modulated to produce a smooth transition between the power-screw being at full rotation speed and coming to a stop. The lever exerts an upward force on the ceiling by being linked with springs. The lever may also rotate a valve beyond a closed condition into a condition that causes the motive force provided to the power-screw to reverse. This action lowers the upper part of the autonomous painting robot in response to a reduction in ceiling height. As the ceiling height varies this adjustment of the turning direction of the power-screw lowers or raises the autonomous painting robot as the height of the ceiling changes. The contact with the ceiling also moves a linkage causing the autonomous painting robot to roll toward a wall.

The autonomous painting robot may be configured with motivators (not shown) on two opposing sides in one or more embodiments. The autonomous painting robot may be configured so that the motivator forces work together on opposing sides of the autonomous painting robot to push the autonomous painting robot into position on the wall even when the sides are placed at different distances from the wall and avoiding obstacles or other disturbances. The physical arrangement of the left side being positioned against the wall independently of the right side being positioned against the wall results in positioning the autonomous painting robot square to the wall. The addition of physical rods of correct length to the front side of the autonomous painting robot act to create a physical "stand-off" position that allows the autonomous painting robot to maintain a set distance from the wall.

The motivator force may be allowed to run at full force as the autonomous painting robot's impact with the wall may be regulated with springs. The action of the motivators continually pushing the autonomous painting robot forward act to hold the autonomous painting robot in position against the wall. This configuration may be improved by introducing a lever positioned in such a way that by being pressed against the wall causes motive power to be reduced as described in the interaction with the upper part of the autonomous painting robot and the ceiling. The lever on the left side may be arranged to reduce the motive power on the left side. The lever on the right side may be arranged to reduce the motive power on the right side. Acting together, the levers control valves that reduce the motive power to allow the autonomous painting robot to remain in place against the wall.

Once both sides have reached their position, linkages may align in a way to turn valves and cause a separate set of motivators arranged on the front and back sides of the autonomous painting robot to activate. These motivators may be attached to wheels positioned to move the autonomous painting robot parallel to the wall. This may cause a disruption in the alignment of the autonomous painting robot and the autonomous painting robot may lose the parallel position with the wall. As the left side loses contact with the wall, the spring-loaded lever on the left side, which had been in contact with the wall, reduces its pressure on the valve restricting the flow of motive power on the left side wheel. As this happens, motivator power may be increased on the left side. As the motivator power on the left side and right side increases, the autonomous painting robot may be moved back into position against the wall. The actions of the front and back wheels combined with the intermittent and self-regulating actions of the left and right-side wheels serve to guide the autonomous painting robot along the wall.

In this configuration, the autonomous painting robot may be moving from left to right along a wall or other targeted area. The autonomous painting robot may be configured to continue along the wall until it comes into contact with the wall, which forms a corner with the wall, which it may be currently following. The autonomous painting robot, in this exemplary embodiment, may have a lever on the right side, which comes into contact with the wall on the right. This lever may be of sufficient length to function as a "Stand-Off" to allow the autonomous painting robot to perform its next function. As this lever comes into contact with the wall on the right, the pressure moves linkages, which reverse the flow of motive power in the right-side wheel and the back-side wheel. This causes the autonomous painting robot to rotate in the clockwise direction. As the autonomous painting robot performs its clockwise rotation the left side of the autonomous painting robot continually follows the wall.

As the autonomous painting robot rotates into position against this second wall the lever on the right side of the autonomous painting robot may be angled to allow it to lose contact with the wall and cause the autonomous painting robot to resume its path along the second wall. However, the contact with the second wall has moved a lever that now redirects the motivator forces to a power-screw connected assemblage that presses a paint-roller against the wall, pumps paint onto the paint-roller, rolls the paint-roller in strokes up and down the wall as set within the autonomous painting robot and then resets the lever that had heretofore redirected the motive power to the power-screw back into the position that causes the autonomous painting robot to resume moving in a left to right direction on the second wall.

A simple arrangement to regulate the movement of the autonomous painting robot has been made by configuring levers to be placed in position on the floor and/or ceiling and allowing the main body of the autonomous painting robot to travel unimpeded along the wall for a distance equal to the width of the paint-roller. After the autonomous painting robot has traveled along the wall to the point on the floor or ceiling located as the beginning point of the next stroke of paint, the configuration of the autonomous painting robot causes it to place another stroke of paint on the wall. The action continues until the wall has been processed. At this point the autonomous painting robot executes its turn against the third wall. Each turn at a wall causes linkages in a counting system to track the number of walls the autonomous painting robot has encountered. This allows for monitoring the process and setting limits for the process. This autonomous painting robot may be configured to process four walls and to then disengage its motive systems.

The autonomous painting robot may be placed in an environment, search for the boundaries of the targeted application area as scan the walls for any colors, patterns, or obstacles, and cover the targeted application area. The autonomous painting robot provides a simplistic, light weight, inexpensive robot that no longer requires manual labor while rapidly decreasing the time needed to paint one or more walls.

The foregoing description of the invention has been presented for purposes of illustration and description and is not intended to be exhaustive or to limit the invention to the precise form disclosed. Many modifications and variations are possible in light of the above teaching. The embodiments were chosen and described to best explain the principles of the invention and its practical application to thereby enable others skilled in the art to best use the invention in various embodiments and with various modifications suited to the use contemplated. The scope of the invention is to be defined by the above claims.

What is claimed is:

1. A method for an autonomous painting robot painting a targeted application area, the method comprising the steps of:

positioning an autonomous painting robot on a surface, the autonomous painting robot having a propulsion system generating movement and an applicator system applying paint to a targeted application area;

generating input data representative of conditions during operation, the input data generated by one or more sensors;

providing the input data to the controllers;

comparing the input data with expected reference values, the reference values stored on the controllers;

outputting an output signal, the output signal derived from the comparison of the input data with the expected reference values;

performing one or more actions in response to the output signals in at least one of the propulsion system and the applicator system to satisfy a condition of the input data returning to the expected reference values;

generating input data, wherein the input data is a calculated distance of the autonomous painting robot from the targeted application area and is generated by the sensors;

sending the input data to the one or more controllers; and the one or more controllers comparing the input data with an expected reference value stored on the controllers, wherein the expected reference value is an expected set distance of the autonomous painting robot from the targeted application area, the one or more controllers outputting an output signal to the propulsion system, the output signal derived from the comparison of the input data with the expected reference values, the propulsion system in response to output signal, increasing and decreasing speed as the autonomous painting robot moves closer or farther to the expected set distance of the autonomous painting robot from the targeted application area;

outputting an output signal to the propulsion system when the calculated distance of the autonomous painting robot from the targeted application is equal to the expected set distance of the autonomous painting robot from the targeted application, the propulsion system in response to output signal moving autonomous painting robot along the targeted application area while maintaining a parallel position to the targeted application area and moving a mast carrying a sensor head in a linear direction allowing the sensor head to scan the wall;

wherein the mast is a linear motion actuator comprising a travel plate with a threaded region fitted to a power-screw, the power-screw turnable by a motor to move the travel plate in a vertical motion, the torsional force of the power-screw configured to be resisted by a sliding stabilizing bar connection, the sliding stabilizing bar connection acting as a conduit to allow liquids, wiring, powders, or other materials to pass through inside the sliding stabilizing bar connection.

2. The method of claim 1, wherein the sliding stabilizing bar connection is a conduit configured to allow liquids, wiring, powders, or other materials to pass through inside the sliding stabilizing bar connection.

3. An automated painting robot for painting a targeted application area, comprising:

an applicator system, the applicator system having an applicator configured to apply paint to a targeted application area;

a linear motion actuator comprising a travel plate with a threaded region fitted to a power-screw, wherein the power-screw is configured to be turned by a motor to move the travel plate in a vertical motion, the torsional force of the power-screw configured to be resisted by a sliding stabilizing bar connection;

a propulsion system configured to generate omnidirectional movement; and one or more sensors connected to one or more controllers, the sensors configured to generate input data representative of conditions during operation and to provide input data to the controllers, the controllers configured to store one or more expected reference values, to compare the input data with the expected reference values, and to output an output signal, the output signal derived from the comparison of the input data with the expected reference values, the output signal configured to perform one or more actions in at least one of the propulsion system and the applicator system to satisfy a condition of the input data returning to expected reference values.

4. The autonomous painting robot of claim 3 further comprising, a sensor head connected to the linear motion actuator, the linear motion actuator configured to enable the sensor head to move in a vertical linear direction.

5. The autonomous painting robot of claim 3, wherein the sliding stabilizing bar connection is a conduit configured to allow liquids, wiring, powders, or other materials to pass through inside the sliding stabilizing bar connection.

6. The autonomous painting robot of claim 3, wherein the applicator is paint roller, spray nozzle, brusher, or printer.

7. The autonomous painting robot of claim 3, further comprising a removable and refillable reservoir for containing paint to be applied to the targeted application area.

8. The autonomous painting robot of claim 7, further comprising a pump configured to apply pressurized paint from the reservoir to the applicator.

9. The autonomous painting robot of claim 3, the propulsion system comprised of a left wheel assembly and a right wheel assembly, the left wheel assembly and right wheel assembly each having a front and rear wheel, the left wheel assembly and right wheel assembly each having their own independently operated motors.

10. The autonomous painting robot of claim 9, wherein the distance between the front and rear wheels of left wheel assembly and right wheel assembly is smaller than the distance between the left and right wheels as to provide omnidirectional turning capabilities.

* * * * *